US010959464B2

(12) United States Patent
Harrison et al.

(10) Patent No.: US 10,959,464 B2
(45) **Date of Patent: *Mar. 30, 2021**

(54) VAPOR DELIVERY SYSTEMS AND METHODS

(71) Applicant: Zenigata LLC, Tacoma, WA (US)

(72) Inventors: Christopher B. Harrison, Vashon, WA (US); Steven A. Rodriguez, Seattle, WA (US); Gregory A. Kirkos, Seattle, WA (US); Alga Lloyd Nothern, III, Seattle, WA (US); Dainia Edwards, Issaquah, WA (US); Joseph N. Kennelly Ullman, Seattle, WA (US); Eric W. Healy, Seattle, WA (US)

(73) Assignee: Zenigata LLC, Tacoma, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/777,570

(22) Filed: Jan. 30, 2020

(65) Prior Publication Data

US 2020/0337371 A1 Oct. 29, 2020

Related U.S. Application Data

(63) Continuation of application No. 16/365,057, filed on Mar. 26, 2019, now Pat. No. 10,588,356, which is a continuation of application No. 16/137,348, filed on Sep. 20, 2018, now abandoned, which is a continuation of application No. 15/418,435, filed on Jan. 27, 2017, now abandoned.

(60) Provisional application No. 62/288,314, filed on Jan. 28, 2016.

(51) Int. Cl.

| | |
|---|---|
| ***A24F 47/00*** | (2020.01) |
| ***A24F 7/02*** | (2006.01) |
| ***A24F 40/40*** | (2020.01) |
| *A24F 40/44* | (2020.01) |

(52) U.S. Cl.

CPC ..... *A24F 47/008* (2013.01); *A24F 7/02* (2013.01); *A24F 40/40* (2020.01); *A24F 40/44* (2020.01)

(58) Field of Classification Search

CPC ..... A24F 47/008; A24F 40/44

See application file for complete search history.

(56) References Cited

U.S. PATENT DOCUMENTS

| | | | |
|---|---|---|---|
| 5,060,671 | A | 10/1991 | Counts et al. |
| 5,095,921 | A | 3/1992 | Losee et al. |
| 5,144,962 | A | 9/1992 | Counts et al. |
| 5,179,966 | A | 1/1993 | Losee et al. |
| 5,261,424 | A | 11/1993 | Sprinkel, Jr. |

(Continued)

*Primary Examiner* — Tho D Ta

(74) *Attorney, Agent, or Firm* — Seed IP Law Group LLP

(57) ABSTRACT

There is provided an electronically controlled, breath actuated vaporization device for generating vaporized material for inhalation by a user. The vaporization device includes a vaporization chamber for accommodating material to be vaporized and a mesh heater or other heater supported upstream of the vaporization chamber which is operable to heat air that passes through the mesh heater or other heater during an inhalation event. A closed loop control scheme may be employed to control heat generated by the heater to maintain a temperature of the air delivered to the vaporization chamber at or within a predetermined tolerance of a desired vaporization temperature for at least a majority of a duration of the inhalation event.

21 Claims, 13 Drawing Sheets

(56) References Cited

U.S. PATENT DOCUMENTS

| | | | |
|---|---|---|---|
| 5,372,148 | A | 12/1994 | McCafferty et al. |
| 5,819,756 | A | 10/1998 | Mielordt |
| 6,095,153 | A | 8/2000 | Kessler et al. |
| 6,688,313 | B2 | 2/2004 | Wrenn et al. |
| 6,810,883 | B2 | 11/2004 | Felter et al. |
| 7,997,280 | B2 | 8/2011 | Rosenthal |
| 8,091,558 | B2 | 1/2012 | Martzel |
| 8,550,069 | B2 | 10/2013 | Alelov |
| 8,714,150 | B2 | 5/2014 | Alelov |
| 8,739,786 | B2 | 6/2014 | Postma |
| 8,820,330 | B2 | 9/2014 | Bellinger et al. |
| 9,155,848 | B2 | 10/2015 | Emarlou |
| 9,226,525 | B2 | 1/2016 | Liu |
| 10,588,356 | B2 * | 3/2020 | Harrison ..... A24F 47/008 |
| 2004/0020500 | A1 | 2/2004 | Wrenn et al. |
| 2004/0200488 | A1 | 10/2004 | Felter et al. |
| 2012/0234315 | A1 | 9/2012 | Li et al. |
| 2013/0133675 | A1 | 5/2013 | Shinozaki et al. |
| 2013/0152922 | A1 | 6/2013 | Benassayag et al. |
| 2013/0298905 | A1 | 11/2013 | Levin et al. |
| 2014/0064715 | A1 | 3/2014 | Greim et al. |
| 2014/0150810 | A1 | 6/2014 | Hon |
| 2014/0202454 | A1 | 7/2014 | Buchberger |
| 2014/0224245 | A1 | 8/2014 | Alelov |
| 2014/0251324 | A1 | 9/2014 | Xiang |
| 2014/0261492 | A1 | 9/2014 | Kane et al. |
| 2014/0278258 | A1 | 9/2014 | Shafer |
| 2014/0299141 | A1 | 10/2014 | Flick |
| 2014/0332016 | A1 | 11/2014 | Bellinger et al. |
| 2014/0345635 | A1 | 11/2014 | Rabinowitz et al. |
| 2015/0034103 | A1 | 2/2015 | Hon |
| 2015/0059780 | A1 | 3/2015 | Davis et al. |
| 2015/0090256 | A1 | 4/2015 | Chung |
| 2015/0125136 | A1 | 5/2015 | Sanchez |
| 2015/0136158 | A1 | 5/2015 | Stevens et al. |
| 2015/0150305 | A1 | 6/2015 | Shenkal |
| 2015/0173124 | A1 | 6/2015 | Qiu |
| 2015/0173419 | A1 | 6/2015 | Tu |
| 2015/0216235 | A1 | 8/2015 | Liu |
| 2015/0230521 | A1 | 8/2015 | Talon |
| 2015/0237917 | A1 | 8/2015 | Lord |
| 2015/0245658 | A1 | 9/2015 | Worm et al. |
| 2015/0257448 | A1 | 9/2015 | Lord |
| 2015/0272220 | A1 | 10/2015 | Spinka et al. |
| 2015/0272222 | A1 | 10/2015 | Spinka et al. |
| 2015/0282527 | A1 | 10/2015 | Henry, Jr. |
| 2015/0296885 | A1 | 10/2015 | Liu |
| 2015/0313284 | A1 | 11/2015 | Liu |
| 2015/0359263 | A1 | 12/2015 | Bellinger |
| 2016/0000145 | A1 | 1/2016 | Liu |
| 2016/0000149 | A1 | 1/2016 | Scatterday |
| 2016/0235124 | A1 | 8/2016 | Krietzman |
| 2016/0295919 | A1 | 10/2016 | Thomas, Jr. |
| 2017/0119048 | A1 | 5/2017 | Kaufman et al. |
| 2017/0215478 | A1 | 8/2017 | Harrison et al. |

* cited by examiner

Processor
Cortex M0
STM32F030C8T6TR
Battery Temp
Cell Temp
Ambient Temp
Outlet Temp
Pressure Sensor
Pump
Valve
Pump Temp Analog
PWM (50Hz)
Air Current Analog
Vacuum Pressure Analog
Analog
Power Switch
Motor
Power Switch
Motor
Power Switch
Motor

VAPOR DELIVERY SYSTEMS AND METHODS

CROSS-REFERENCE TO RELATED APPLICATIONS

This application is a continuation of U.S. patent application Ser. No. 16/365,057, filed Mar. 26, 2019, which is a continuation of U.S. patent application Ser. No. 16/137,348, filed Sep. 20, 2018, which is a continuation of U.S. patent application Ser. No. 15/418,435, filed Jan. 27, 2017, which claims benefit to U.S. Provisional Patent Application No. 62/288,314, filed Jan. 28, 2016, the entire contents of which are hereby incorporated by reference herein.

BACKGROUND

Technical Field

This disclosure generally relates to vapor delivery systems and methods and, more particularly, to vaporization devices suitable for selectively delivering vaporized material (e.g., plant material, including plant material extracts, concentrates, and derivatives) for inhalation by a user, components thereof and related methods.

Description of the Related Art

Vaporization devices suitable for selectively delivering vaporized plant material for inhalation by a user are well known in the art. Such devices, however, may suffer from a variety of deficiencies and drawbacks, such as, for example, inefficient heat management and delayed vapor delivery arising from prolonged device warmup.

BRIEF SUMMARY

Embodiments described herein provide vaporization devices suitable for selectively delivering vaporized plant material (or other materials) in an efficient and reliable manner for inhalation by a user. Embodiments include vaporization devices comprising a closed loop temperature control technique to drive current from a power source to a forced convection air heater to provide rapid, on-demand vapor delivery. Embodiments may further include breath detection functionality to assist in delivering the vaporized material on-demand. Embodiments may be provided in multi-part form factors including, for example, a vaporization head detachable from a base assembly, which includes the system electronics. The vaporization head includes a vaporization chamber for receiving the material to be vaporized. The vaporization head may be configured to dissipate heat and sufficiently cool the vapor stream for safe and comfortable inhalation by the user. Advantageously, the vaporization devices may be configured to enable a user to safely inhale vaporized plant material on-demand without significant delay despite fluctuations in inhalation strength, inhalation duration, ambient environmental conditions, and/or plant material characteristics (e.g., size, moisture content), thereby enhancing user experience.

DETAILED DESCRIPTION

Figure 1:
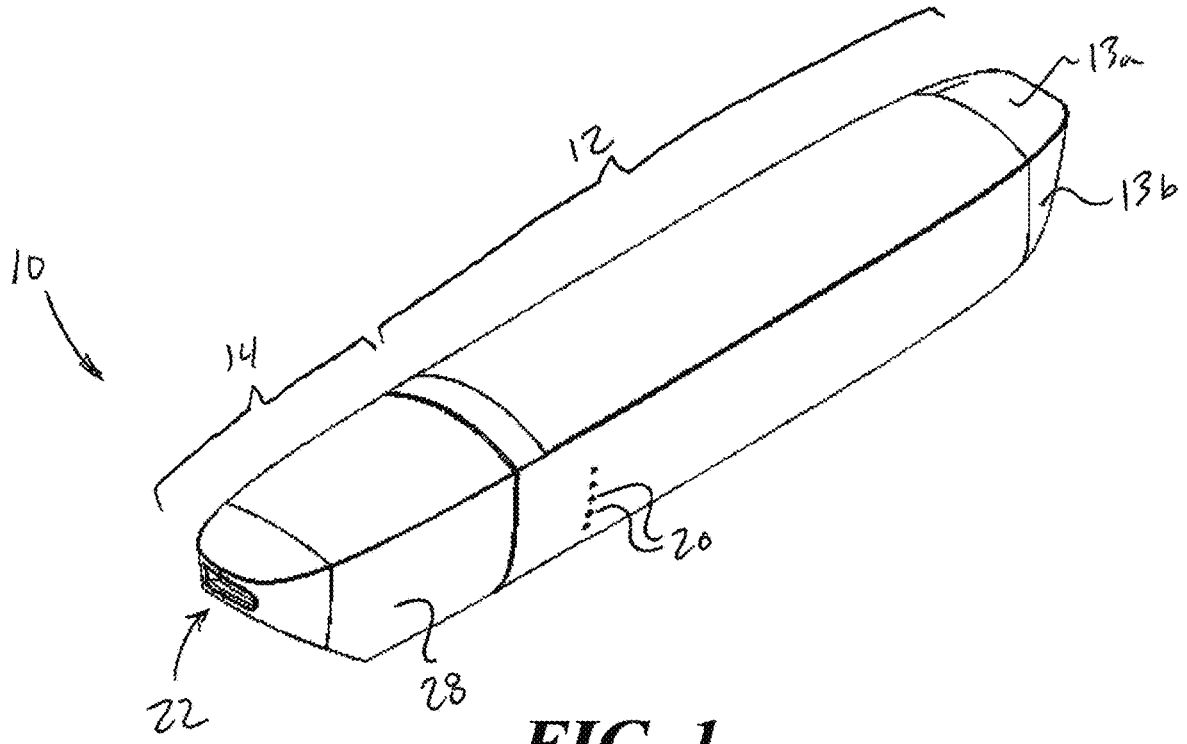
FIG. 1 is an isometric view of a vaporization device, according to one example embodiment, from a top perspective.
Figure 2:
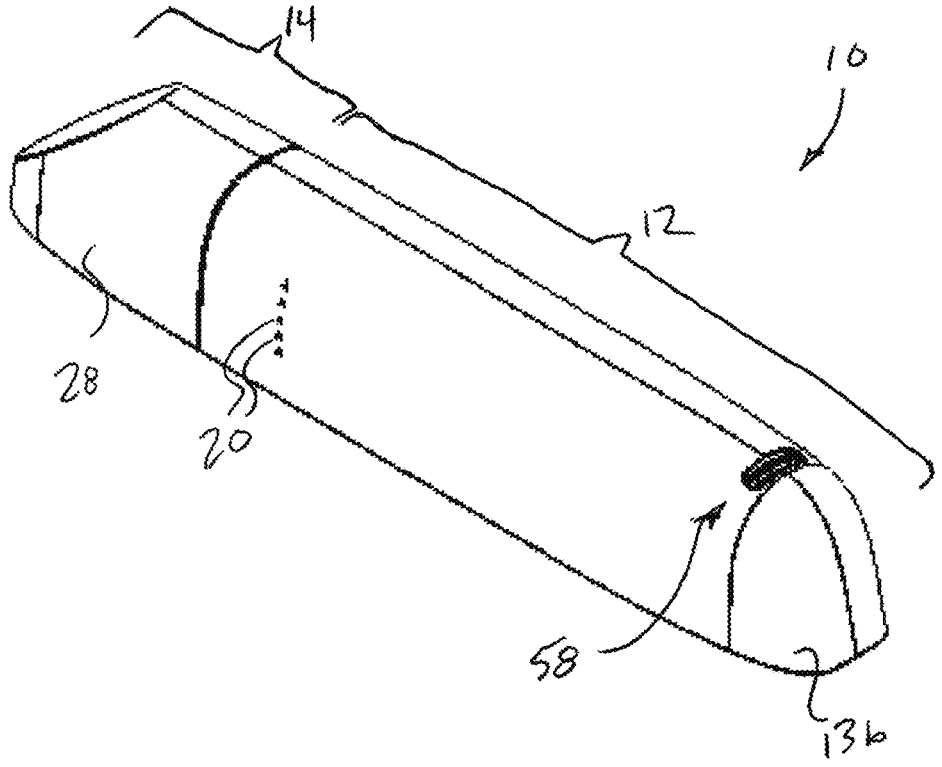
FIG. 2 is an isometric view of the vaporization device of FIG. 1 from a bottom perspective.
Figure 3:
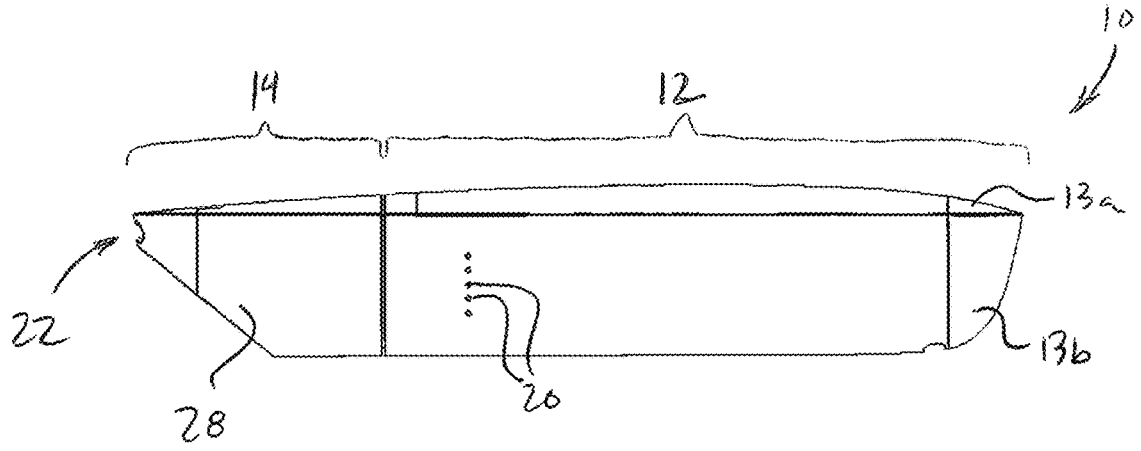
FIG. 3 is a side elevational view of the vaporization device of FIG. 1.
Figure 4:
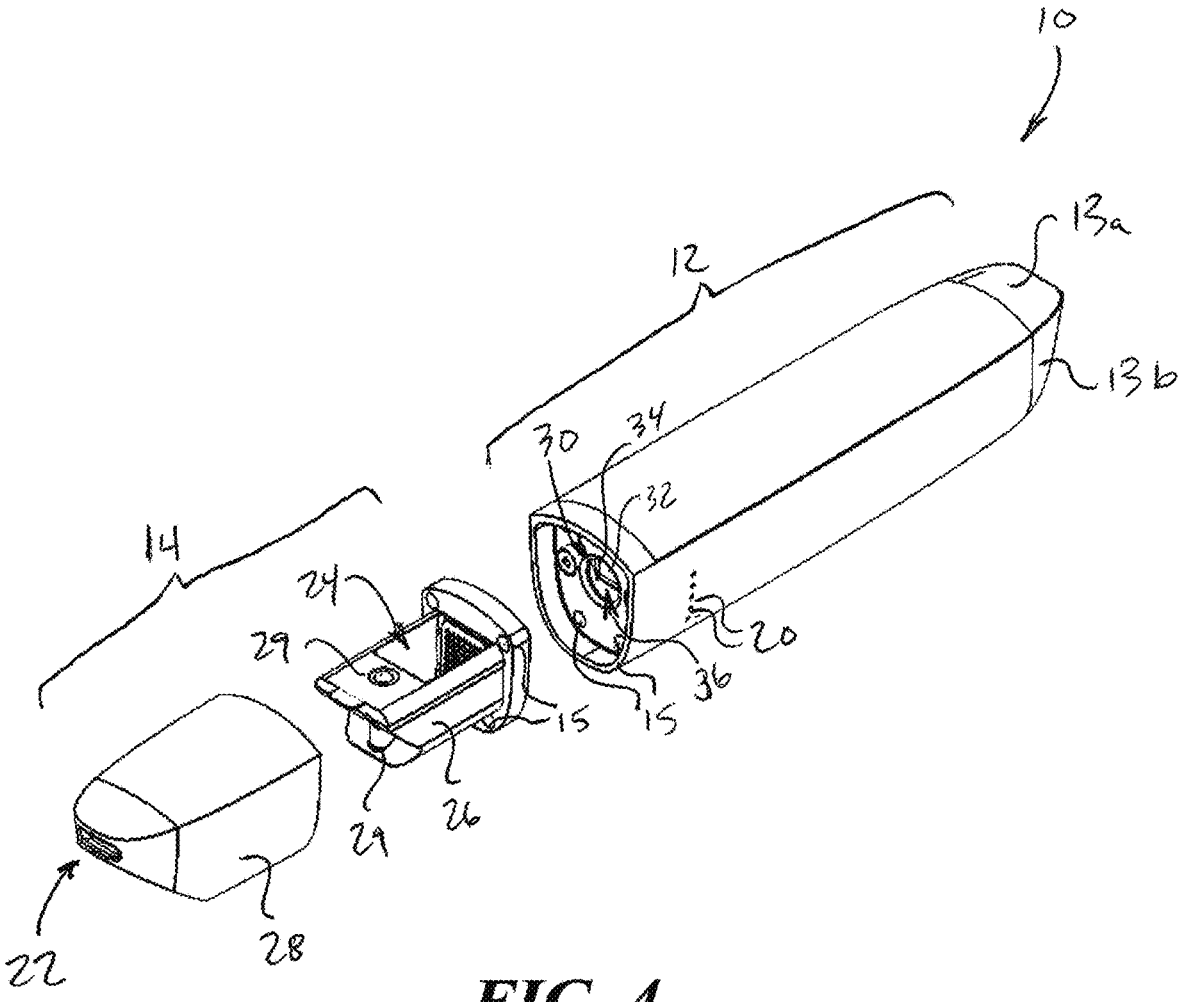
FIG. 4 is an isometric view of the vaporization device of FIG. 1 with a vaporization head detached from a base assembly thereof.
Figure 5:
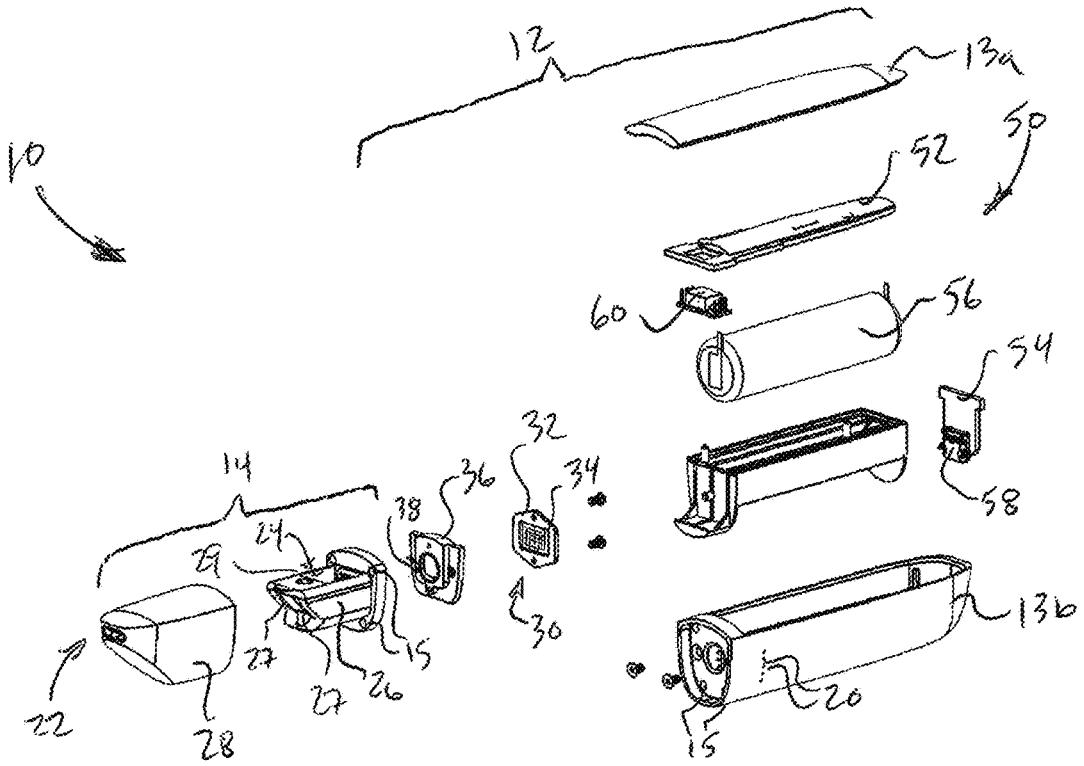
FIG. 5 is a skewed isometric exploded view of the vaporization device of FIG. 1 from a top perspective.
Figure 6:
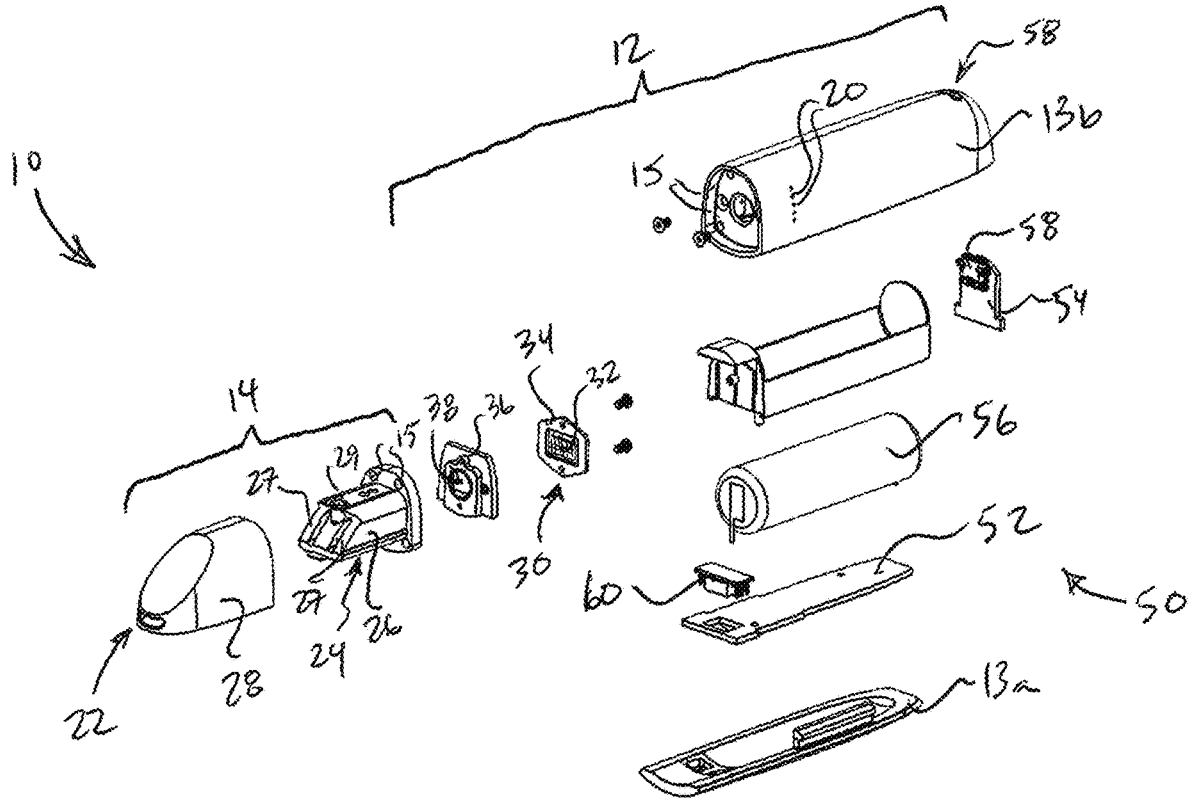
FIG. 6 is a skewed isometric exploded view of the vaporization device of FIG. 1, from a bottom perspective.
Figure 7:
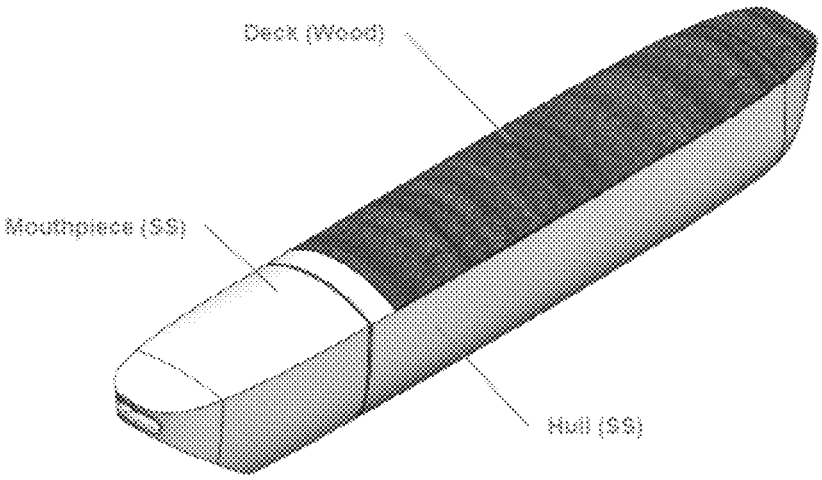
FIG. 7 is an isometric view of a vaporization device, according to another example embodiment, from a top perspective.
Figure 8:
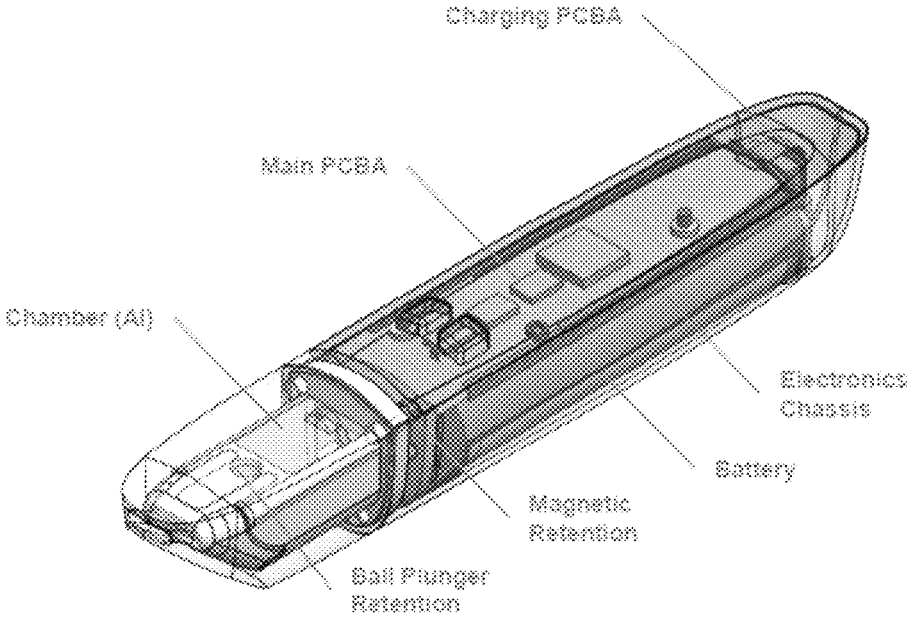
FIG. 8 is an isometric view of the vaporization device of FIG. 7 with external components shown transparent to reveal underlying features and components thereof.
Figure 9:
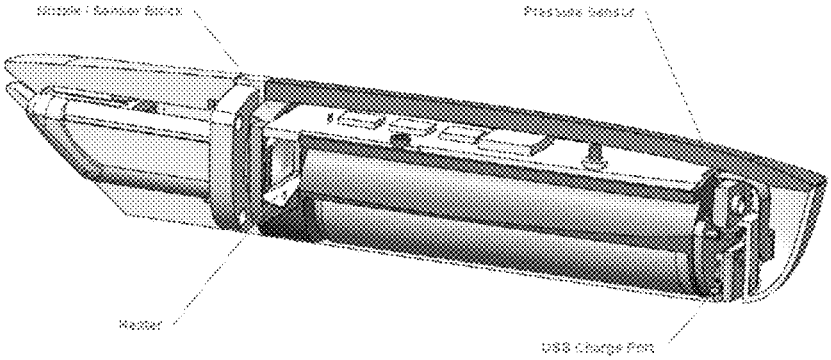
FIG. 9 is a skewed isometric view of the vaporization device of FIG. 7 with external components shown partially cut away to reveal underlying features and components thereof.
Figure 10:
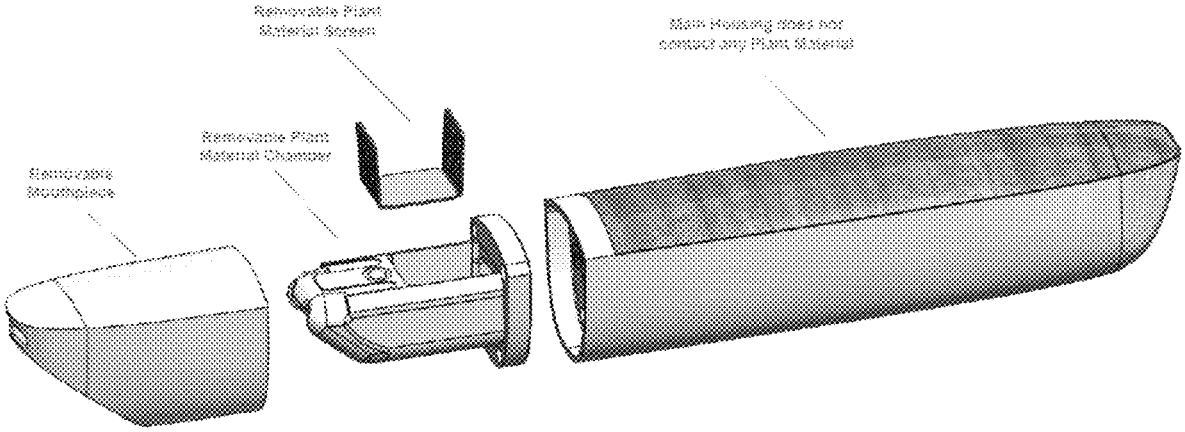
FIG. 10 is a skewed isometric view of the vaporization device of FIG. 7 with a vaporization head detached from a base assembly thereof, and with a removable material screen removed from a vaporization chamber provided by the vaporization head.
Figure 11:
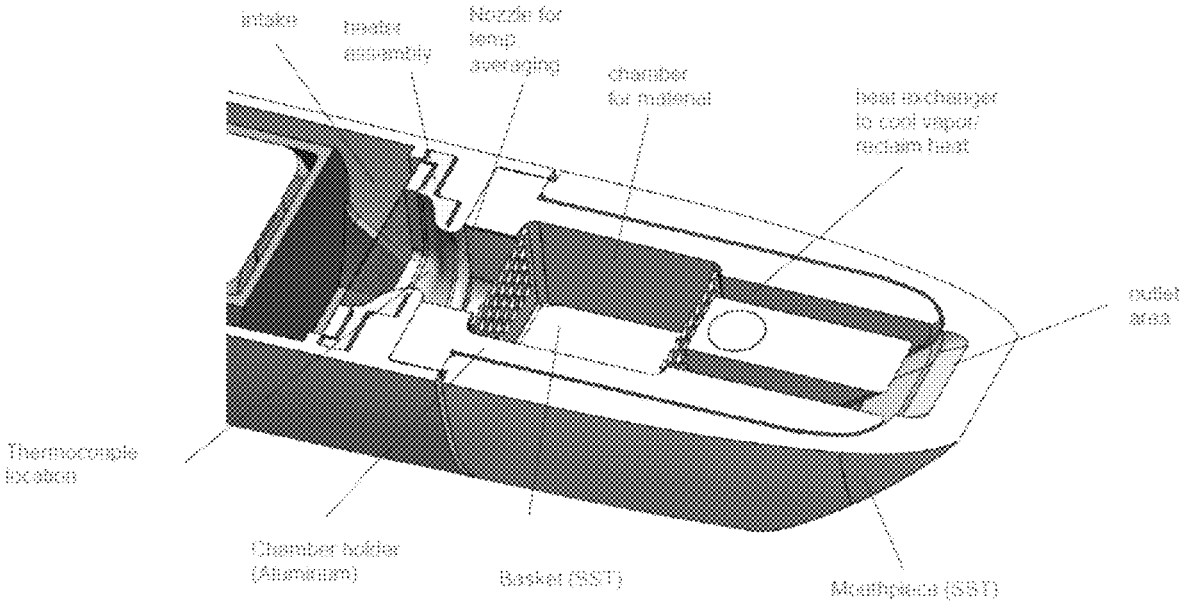
FIG. 11 is a partial cross-sectional view of a front end of the vaporization device of FIG. 7 showing internal features and components of the device.

In the following description, certain specific details are set forth in order to provide a thorough understanding of various disclosed embodiments. However, one of ordinary skill in the relevant art will recognize that embodiments may be practiced without one or more of these specific details. In other instances, well-known structures and devices associated with vapor delivery devices, systems, components or related methods may not be shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments described herein provide vaporization devices suitable for selectively delivering vaporized plant material (or other material) in an efficient and reliable manner for inhalation by a user. Embodiments include vaporization devices that utilize a closed loop temperature control technique to drive current from a power source to a forced convection air heater to provide rapid, on-demand vapor delivery. Embodiments may further include breath detection functionality to assist in delivering the vaporized plant material on-demand. Embodiments may be provided in multi-part form factors including, for example, a vaporization head detachable from a base assembly, which includes the system electronics. The vaporization head includes a vaporization chamber for receiving the material to be vaporized. The vaporization head may be configured to dissipate heat and sufficiently cool the vapor stream for safe and comfortable inhalation by the user. Advantageously, the vaporization devices may be configured to enable a user to safely inhale vaporized plant material on-demand without significant delay despite fluctuations in inhalation strength, inhalation duration, ambient environmental conditions, and/or plant material characteristics (e.g., size, moisture content), thereby enhancing user experience.

Although the vaporization devices and methods described herein are shown and described often in the context of handheld, electronically controlled, breath actuated vaporizer devices for delivering vaporized plant material to a user, it will be appreciated by those of ordinary skill in the relevant art that features and aspects of such devices may be applied to other devices and for other purposes, including, for example, benchtop vaporization devices or systems for delivering vaporized material for recreational, medical or other purposes.

FIGS. 1 through 6 show one example embodiment of a handheld, electronically controlled, battery driven, breath actuated vapor delivery unit in the form of a vaporizer device 10. The vaporizer device 10 includes a base assembly 12, which includes the system electronics contained in a housing 13*a*, 13*b*, and a vaporizer head 14 that is removably coupleable to the base assembly 12 for vaporizing material (e.g., plant material, including plant material extracts, concentrates and derivatives) loaded in the vaporizer head 14 for inhalation by a user. The vaporization head 14 may be removably coupled to the base assembly 12 via a magnetic coupling arrangement 15 or other coupling arrangement, such as, detents, snaps, clips, latches, or other fasteners.

The vaporizer device 10 includes an air intake 20 (e.g., plurality of intake apertures), through which air enters the vaporization device 10 during an inhalation event, and an outlet 22, through which vapor is withdrawn from the vaporization device 10 by the user. The vaporization device 10 further includes a vaporization chamber 24 for accommodating the material to be vaporized. According to the example embodiment shown in FIGS. 1 through 6, the vaporization head 14 may include a heat exchanger 26 and a removable mouthpiece 28 detachably coupled to the heat exchanger 26. The vaporization chamber 24 is defined at least in part by the heat exchanger 26 and is accessible to a user by removing the mouthpiece 28 from the heat exchanger 26. In this manner, a user may conveniently remove or disengage the mouthpiece 28 from the heat exchanger 26 to load the vaporization device 10 with material to be vaporized as desired. The mouthpiece 28 may be removably coupled to the heat exchanger 26 via one or more detent mechanisms 29 or other coupling arrangements, such as, snaps, clips, latches, magnets or other fasteners. In other instances, the vaporization chamber 24 may be selectively accessible to a user without removing the mouthpiece 28. For example, the mouthpiece 28 may slide relative to the heat exchanger 26 to reveal the vaporization chamber 24 while remaining coupled to the heat exchanger 26. In other instances, an access panel or cover may provide access to the vaporization chamber 24.

The heat exchanger 26 includes one or more vapor flow passages 27 extending from the vaporization chamber 24 toward the outlet 22. For instance, the example embodiment of FIGS. 1 through 6 includes a heat exchanger 26 having opposing passages 27 offset from a central plane of the vaporization device 10. The heat exchanger 26 further includes a central portion that provides an obstruction around which the vapor must flow to reach the outlet 22. As the generated vapor moves through the vapor flow passages 27, heat is transferred from the vapor to the heat exchanger 26 to assist in cooling the vapor prior to inhalation by the user. According to the example embodiment, the heat exchanger 26 is configured such that a portion of the heat transferred to the heat exchanger 26 from the vapor is conducted upstream to a location adjacent the vaporization chamber 24 to assist in heating the material to be vaporized via conduction.

The vaporization device 10 further includes a mesh heater 30 supported upstream of the vaporization chamber 24, which is operable to heat air which passes through the mesh heater 30 during each inhalation event as it moves from the air intake 20 toward the outlet 22. The mesh heater 30 may comprise a wire mesh 32 of a first material (e.g., stainless steel) and a frame 34 of a second material (e.g., ceramic material). The wire mesh 32 is fixed to the frame 34 and supported by the frame 34 within the vaporization device 10. The frame 34 may be a portion of a frame assembly that further comprises opposing bus bars (e.g., low resistance, copper bus bars) integrally formed therewith. Opposing ends of the mesh 32 may be bonded (e.g., silver soldered) to the opposing bus bars, along with heater leads (not shown) for supplying electric current through the mesh 32 in accordance with the control system functionality disclosed herein.

The vaporization device 10 may further comprise a nozzle block 36 for supporting the mesh heater 30 upstream of the vaporization chamber 24. The nozzle block 36 may include a nozzle passage 38 that is shaped to funnel air passing through the mesh heater 30 toward a central location (as illustrated best in the example embodiment shown in FIG. 14). The vaporization device 10 may further include one or more temperature sensor(s) (e.g., one or more thermocouple(s)) positioned downstream of the mesh heater 30 which are operable to sense a temperature of the air downstream of the mesh heater 30 at the central location and/or other locations. Temperature readings may be used to control various operational aspects of the vaporization device 10 as described herein. Temperature sensing locations may include immediately downstream of the mesh heater 30 to sense a temperature of the heated air stream generated by the mesh heater 30, within the vaporization chamber 24, immediately downstream of the vaporization chamber 24, at or near the outlet 22, and at or near the air intake 20.

The vaporization device may further include a control system 50, comprising one or more printed circuit board assemblies 52, 54, which is/are operatively coupled to the temperature sensor and the mesh heater 30 to provide a closed loop control scheme for controlling heat generated by the mesh heater 30 so as to maintain a temperature of the air delivered to the vaporization chamber 24 at or within a predetermined tolerance of a desired vaporization temperature for at least a majority of a duration of an inhalation event. The control system 50 may further include a power source 56 (e.g., a low voltage, high current battery) and a charging circuit, including a power connector 58, for enabling the power source 56 of the vaporization device 10 to be recharged as needed.

The vaporization device 10 may further include a pressure sensor 60 operatively coupled to the control system 50 to sense the initiation of an inhalation event. The pressure sensor 60 may be positioned upstream of the mesh heater 30 and configured to sense a drop in pressure as a user begins to inhale on the device 10. Advantageously, the pressure sensor 60 may be used to initiate a soft start of the mesh heater 30 in accordance with aspects of the control methodology described herein prior to employing the closed loop control scheme. In other embodiments, the vaporization device 10 may further include a trigger (e.g., depressible button) to initiate the soft start of the mesh heater 30. In still other embodiments, the pressure sensor 60 may be used to measure pressure periodically or constantly throughout the inhalation event, and the mesh heater 30 may be controlled based at least in part on such pressure measurements.

FIGS. 7 through 11 show a vaporization device having the same or similar features to the example embodiment of the vaporization device 10 of FIGS. 1 through 6. Select features of the vaporization device are labeled in the figures for additional clarity.

Figure 12:
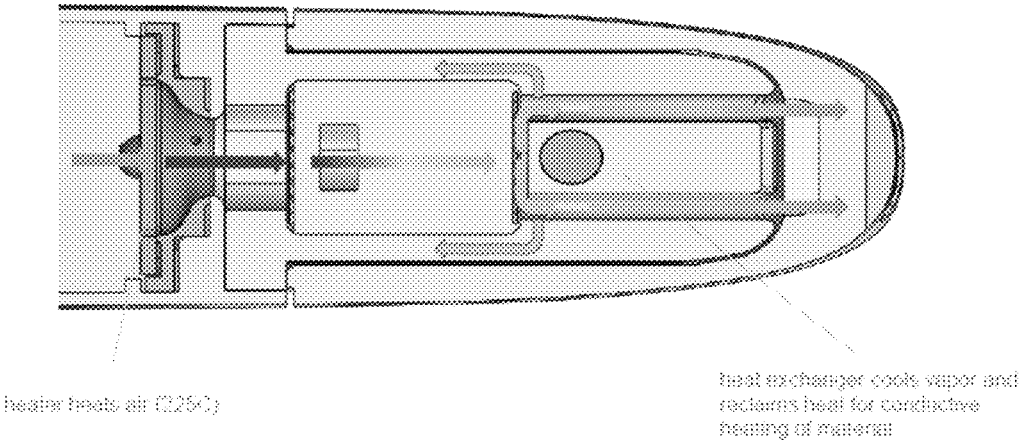
FIG. 12 is a top plan view of the internal components of the vaporization device of FIG. 7 showing a path and relative temperature profile of the air and air-vapor mixture moving through the device during an inhalation event.

FIG. 12 illustrates the air and air-vapor mixture moving through a front end of the vaporization device during an inhalation event. As can be appreciated from a review of FIG. 12, relatively cool ambient air is drawn into the device during inhalation through an air intake, as represented by the blue arrow. Upon passing through a mesh heater, the air is rapidly heated to a desired vaporization temperature (e.g., approximately 225° C. for vaporizing certain types of plant matter), as represented by the red arrow. Then, the heated air interacts with the material to be vaporized in the vaporization chamber to generate an air-vapor mixture that is discharged from the vaporization chamber at a lower exit temperature, as represented by the arrow transitioning from red to yellow. Next, air-vapor mixture moves through vapor flow passages of a heat exchanger whereby heat is transferred from the air-vapor mixture to the heat exchanger to cool the air-vapor mixture to a comfortable temperature before being discharged through the outlet of the vaporization head for inhalation, as represented by the arrows transitioning from yellow to blue. Advantageously, some of the heat from the air-vapor mixture may be reclaimed by the heat exchanger for conductive heating of the material to be vaporized, as represented by the yellow arrows outlined in broken lines.

Figure 13:
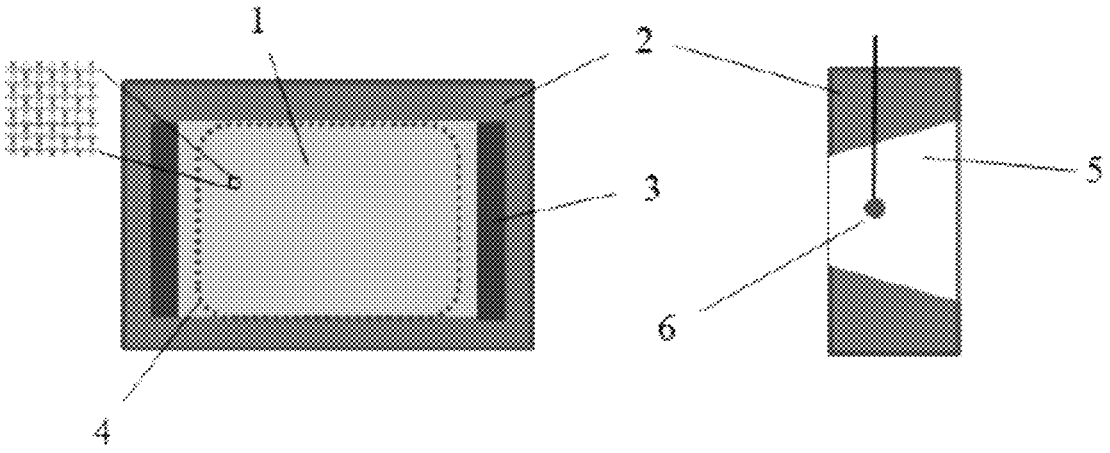
FIG. 13 provides diagrams of a mesh heater, according to one embodiment, from front and side perspectives.

FIG. 13 provides a schematic representation of a mesh heater according to aspects of the vaporizer devices described herein. The mesh heater is a compact, high power density, high efficiency forced-convection air heater for flowing air which is configured to provide a rapid rate of heating. The mesh heater is depicted in FIG. 13 with a wire mesh resistive element 1 held in housing 2, which is electrically insulating or has an insulating layer. Bus bars 3 provide connections at opposing ends of the wire mesh resistive element 1, and are connected to wire leads (not shown) which provide electrical power to the heating element (i.e., wire mesh resistive element 1). An air opening 4 is provided adjacent the mesh, and converges to a nozzle/mixer 5, wherein a temperature measurement element 6 is provided. The mesh heater rapidly heats air through forced convection. Electrical current is passed through the mesh resistive element 1, which then heats to a high surface temperature. Air flowing through the mesh heater is heated by the wire mesh resistive element 1. The mesh heater is of low electrical resistance, and the convection is very efficient, two factors which combine to give the heater a fast thermal time constant and effect a rapid heating rate of the air. Heated air flows into the nozzle/mixer 5 and heats the temperature measurement element 6, which can be used to effect closed-loop temperature control. The bus bars 3 are connected to the mesh 1 with a low resistance connection. The housing 2 is mechanically robust, which protects the delicate wire mesh resistive element 1 from external physical loads. The housing 2 also provides thermal management of the wire leads (not shown). The material of the mesh 1 may have a positive temperature coefficient of resistance, which helps to self-limit the temperature of the heater during operation.

Advantageously, the mesh heater provides a particularly compact and efficient form factor for transferring a large amount of heat into a flow of air, especially when considering power consumption in relation to heat transferred into the moving air stream. The mesh heater may provide a particularly rapid heating rate of the air flow (e.g., up to and exceeding 100° C., 150° C. or 200° C. per second) with the use of a low-mass, low impedance mesh heating element 1. The heating element may be a single piece of fine wire mesh 1. The heating element may be designed to be powered with a low voltage, high current battery. The heating element may provide particularly efficient heating as nearly all power consumed may be transferred to the moving air stream via convection with minimal losses. The heating element may provide a high surface area-to-volume ratio thereby providing a high thermal power density. The mesh heater may comprise a mechanically robust form factor having an integrated housing 2. The temperature measurement element 6 may be integrated with the housing 2 and supported at a central location. The housing 2 may provide a nozzle or funnel which forces the air flowing through the mesh resistive element 1 to mix so that a single point temperature measurement more accurately represents the average temperature of the flowing air stream. The mesh resistive element 1 may comprise stainless steel, which has the property of self-limiting the electrical current through the mesh resistive element 1 since the electrical resistance of the stainless steel mesh increases with temperature as it heats up. This helps prevent the mesh resistive element 1 from self-fusing or from other damage. The stainless steel mesh resistive element 1 may provide a safer material with regard to biocompatibility and inhalation when compared to Nichrome (NiCr) and other common resistive heating element materials.

Although the example embodiment of the vaporizer device 10 shown in FIGS. 1 through 6 and other embodiments are described as including a mesh heater, it is appreciated that in other embodiments, other types of heaters and heating elements may be used in conjunction with other aspects and features of the vaporization devices, components and related methods disclosed herein. For example, a heater element in the form of a coil, pancake coil, wire screen, wire array or other heater element device or arrangement may be provided in lieu of the wire mesh 32.

Figure 14:
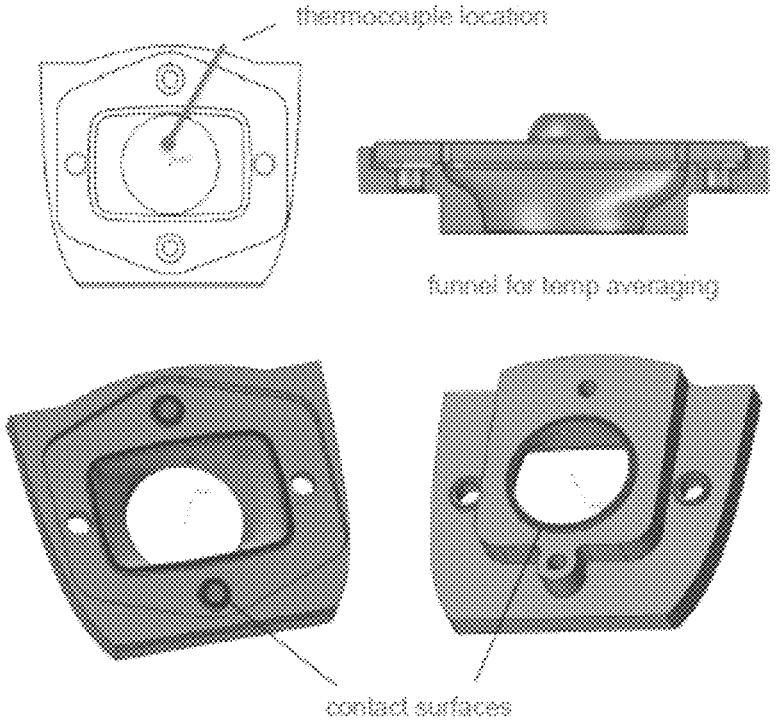
FIG. 14 shows additional details of an example embodiment of a nozzle block for supporting a mesh heater within the vaporization device.

FIG. 14 shows different views of an example nozzle block (similar to nozzle block 36 of FIGS. 5 and 6) to further illustrate an example of a location of the temperature sensor and funneling characteristics of the nozzle passage thereof, which may assist in mixing the heated air stream to obtain a more accurate reading of the average air temperature of the air stream passing through the mesh heater (or other heater). In addition, FIG. 14 highlights features of the example nozzle block which help manage heat management within the device. As can be appreciated from a review of FIG. 14, the mesh heater may be held offset from the nozzle block via one or more bosses such that, apart from the one or more bosses, a space is maintained between the mesh heater and the nozzle block. This helps to reduce conductive heat transfer from the mesh heater to the nozzle block during operation. Although the bosses are shown as being integrally formed with the nozzle block, it is appreciated that the bosses may be provided by the frame of the mesh heater rather than the nozzle block. Alternatively, one or more spacers or mounting members may be provided in lieu of bosses. The nozzle block may also be held offset from the device housing via one or more bosses such that, apart from the one or more other bosses, a space is maintained between the nozzle block and the housing. This helps to reduce conductive heat transfer between the nozzle block and the housing during operation. Although the bosses are shown as being integrally formed with the nozzle block, it is appreciated that the bosses may be provided by the housing rather than the nozzle block. Alternatively, one or more spacers or mounting members may be provided in lieu of bosses.

Figure 15:
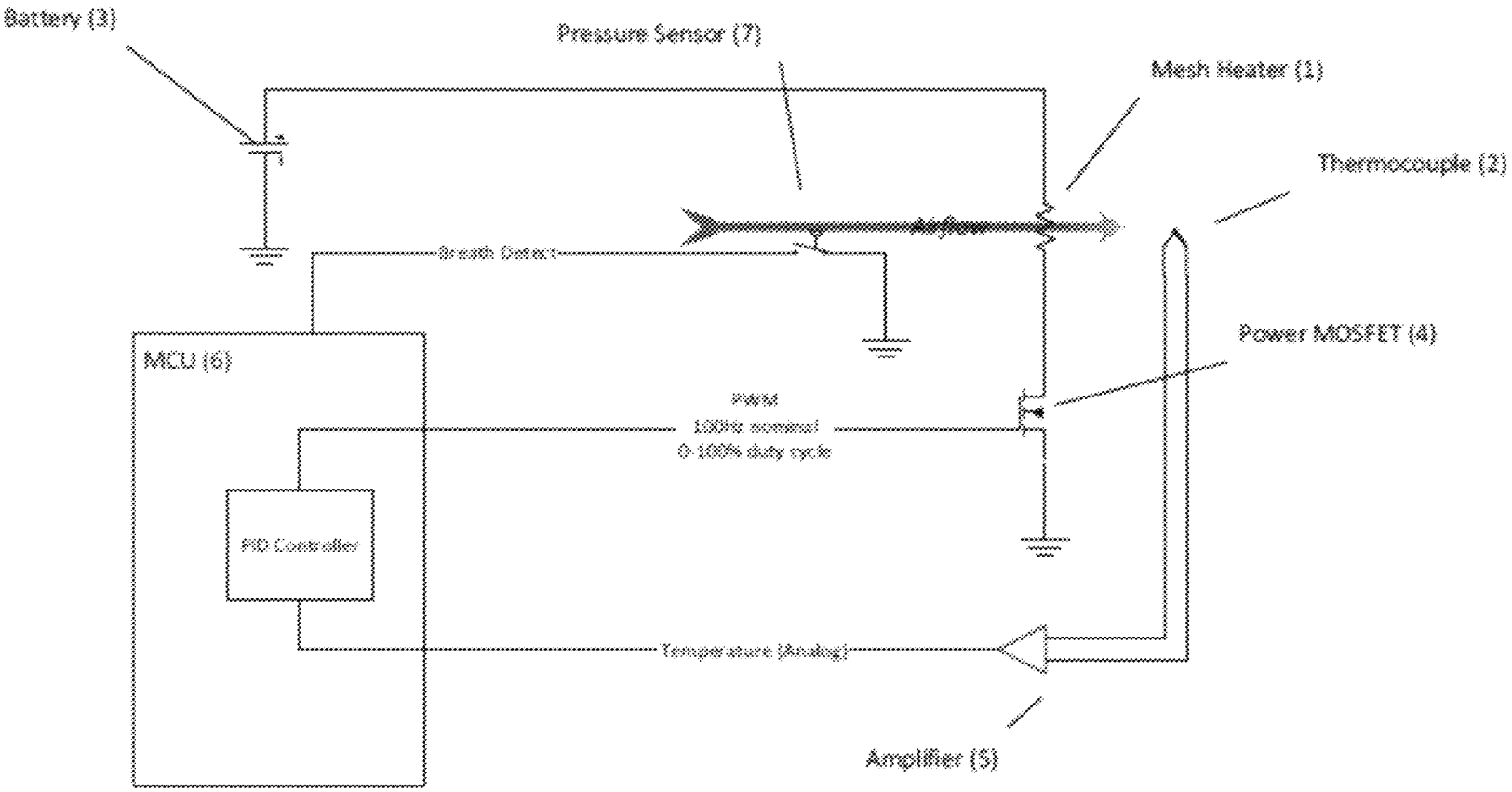
FIG. 15 provides a schematic diagram of a closed loop air temperature control system, according to one example embodiment.
Figure 16:
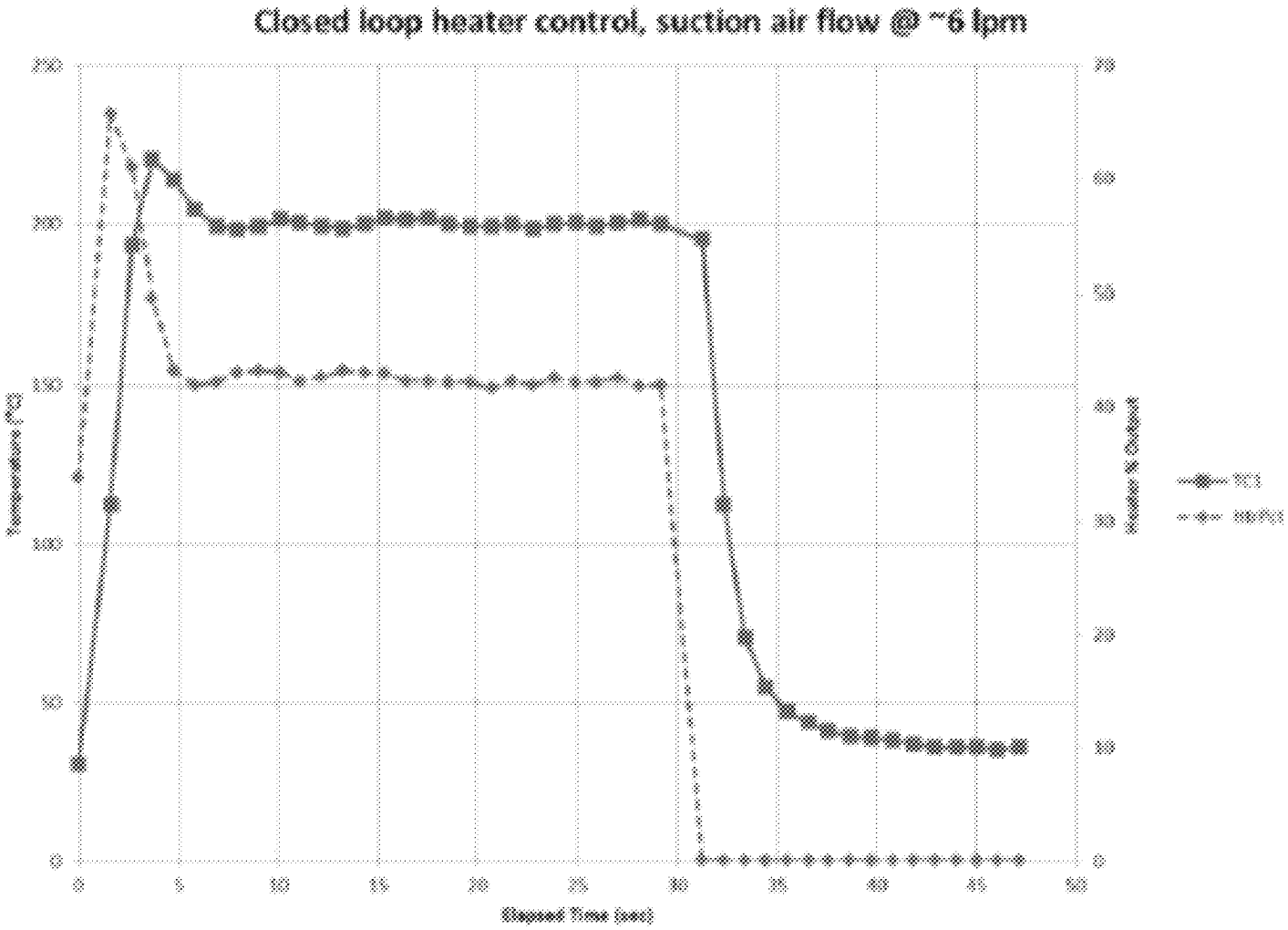
FIG. 16 provides an example plot of air temperature and corresponding heater output percentage over an approximately 30 second inhalation event in accordance with a closed loop air temperature control scheme.

FIG. 15 provides a schematic of a closed loop air temperature control scheme that may be employed with embodiments of the vaporizer devices described herein. The closed loop air temperature control scheme may be used to quickly and accurately heat air to a given temperature set point over a wide range of flow rates, ambient conditions, and battery states in order to vaporize target constituents of the material to be vaporized and inhaled. The mesh heater (1), expressed schematically in FIG. 15 as a resistor, may comprise a fine stainless steel mesh through which air passes when a user inhales via a mouthpiece. Air temperature is measured with a thermocouple (2) (or other temperature sensor) placed in the air path, downstream of the heater (1). The thermocouple signal is conditioned and amplified by an amplifier (5) for measurement by an analog-to-digital converter (ADC) located within a microcontroller (MCU) (6). When the user activates the heater (1) (such as by inhaling on the mouthpiece), a software PID loop (or other control loop feedback mechanism) in the MCU (6) adjusts the output of the heater (1) based on feedback from the signal of the thermocouple (2). Generally, if the thermocouple measurement is less than the desired air temperature, the heater output is increased. If the thermocouple measurement is greater than the desired air temperature, the heater output is decreased. The heater output will be adjusted throughout a use cycle in order to maintain an output temperature that is equal to or within an acceptable tolerance (e.g., ±5° C., ±2° C.) of a desired set point or vaporization temperature. One side of the heater (1) is connected to a power source (3) of the device, and the other side is connected to a power MOSFET (4). When the gate of the MOSFET (4) is driven high by the MCU (6), current passes through the heater (1) and the MOSFET drain/source. When the gate of the MOSFET (4) is driven low, the heater (1) is turned off and no current flows. The on/off duty cycle may be modulated between 0-100% based on the feedback from the thermocouple (2). Pulse width modulation (PWM) may be employed in the control scheme at a frequency of 100 Hz, or at other frequencies. FIG. 16 provides a representative graph of the temperature control scheme employed over about a 30 second inhalation event.

The closed loop air temperature control scheme provides enhanced temperature control to provide an improved user experience as compared to other vaporizer devices which may set a heater element at a fixed output without feedback from a temperature sensor, which would result in inaccurate temperature control outside of narrow default operating conditions, such as flow rate, ambient temperature, and battery voltage. Measuring the temperature of the heated airstream directly, rather than the heater element, provides enhanced control of the user experience over a wider range of dynamic operating conditions (e.g., flow rate, ambient temperature, and battery voltage). Advantageously, monitoring the air temperature with a fine-wire thermocouple minimizes the thermal mass of the sensor, and thus response time. This allows increased accuracy of heater adjustment that may self-correct for different inhalation rates, ambient temperatures, and/or battery voltages, even if these parameters are changing significantly within a single-use.

The closed-loop air temperature control scheme is designed for the purpose of vaporizing target constituents on-demand in a target material (e.g., plant material, including plant material extracts, concentrates, and derivatives) for inhalation, and may be configured in conjunction with the mesh heater to provide up to and exceeding 100 W to provide a fast response while heating air 200° C. or more above ambient over a wide range of flow rates (e.g., up to 10 liters per minute or more). An efficient heater design will have near zero conducted heat loss to its surrounding environment, such that all power provided to the heater will be convectively transferred to the flowing air. As the design approaches this ideal, it is imperative that the heater only be activated when air is flowing in order to avoid heating the system without an accompanying heat loss path.

The mesh heater is controlled via closed-loop control, with feedback coming from a thermocouple in the air path downstream from the heater. Without air moving through the heater, the air around the temperature sensor may heat slightly, but not nearly enough to approach the desired set point at the temperature sensor downstream from the heater. Accordingly, the closed loop control would quickly increase the heater output to 100% without any forced convection air heat transfer, resulting in extremely high temperatures at the heater element. This has the effect of shortening heater and battery life, and, eventually, causing uncomfortable or, possibly, dangerous touch temperatures at the surface of the device. Accordingly, in order to mitigate this risk, a method for turning on the heater at a low level momentarily in order to verify expected thermal response from the air, and thus air velocity beyond a minimum threshold, has been developed. This method assures that the temperature control of the heater is only activated during a valid breath.

As previously described, the mesh heater (1), expressed schematically as a resistor, may comprise a fine mesh through which air passes when a user inhales via a mouthpiece. Air temperature is measured with a thermocouple (2) placed in the air path, downstream of the mesh heater (1). The thermocouple signal is conditioned and amplified by an amplifier (5) for measurement by an analog-to-digital converter (ADC) located within the MCU (6). A pressure sensor (7) may be included upstream of the heater for the purpose of detecting air flow. When air flow above a minimal threshold is detected, a heater soft start may be initiated. The heater soft start is accomplished by enabling the heater at a low duty cycle (e.g., 5% or less, 2% or less) and monitoring the temperature sensor output for a rapid thermal response. In the absence of adequate airflow, the reported temperature will increase, but only slowly. With airflow, the temperature increases much more rapidly. By monitoring the rate of temperature change, dT/dt, the heater feedback control loop is initiated only when dT/dt exceeds a software configurable threshold. If a heater soft start exceeds a software configurable timeout period, the heater is completely disabled and will not start again until a new breath is detected with the pressure sensor (7) or other detection means.

Once initiated, the feedback control loop in the MCU (6) adjusts the heater output based on feedback from the temperature sensor signal. Generally, if the temperature sensor measurement is less than the desired air temperature, the heater output is increased. If the temperature sensor measurement is greater than the desired air temperature, the heater output is decreased. The heater output will be adjusted throughout a use cycle in order to maintain an output temperature that is equal to or within an acceptable tolerance of the desired set point or vaporization temperature.

Advantageously, the soft start and associated control scheme enables on-demand use of the vaporizer device without preheating, which would otherwise require a more powerful heater and additional safeguards to prevent false triggering, and which may scorch the material or otherwise degrade the quality of the vapor and subsequent user experience. The soft start function also allows detection of adequate air flow prior to enabling closed-loop control of the heater to its set point temperature. This function is implemented without requiring any additional components beyond what is needed for typical closed-loop control. Although the soft start is described as being triggered by breath detection via a pressure sensor (7), it is appreciated that in other embodiments a user accessible trigger or other control may be provided in addition to or in lieu of the pressure sensor (7) for triggering the soft start.

The control system may also be configured to disable the mesh heater and stop the closed loop feedback control scheme upon detection of a divergence of a measured air temperature associated with a delivered heater power from an expected air temperature, the divergence arising from a lack of air flow through the vaporization device (i.e., cessation of the inhalation event). For example, the mesh heater may be operated at a given level (e.g., 40%±2%) to maintain a desired vaporization temperature (e.g., 200° C.±5° C.). Then, upon cessation of the inhalation event, the sensed temperature may drop significantly despite maintaining the mesh heater at the same power level given the lack of moving air that would otherwise transfer heat generated by the mesh heater to the location of the temperature sensor. This divergence thus signals that air flow has ceased and that the closed loop control scheme should be disabled until another inhalation event occurs.

Figure 17:
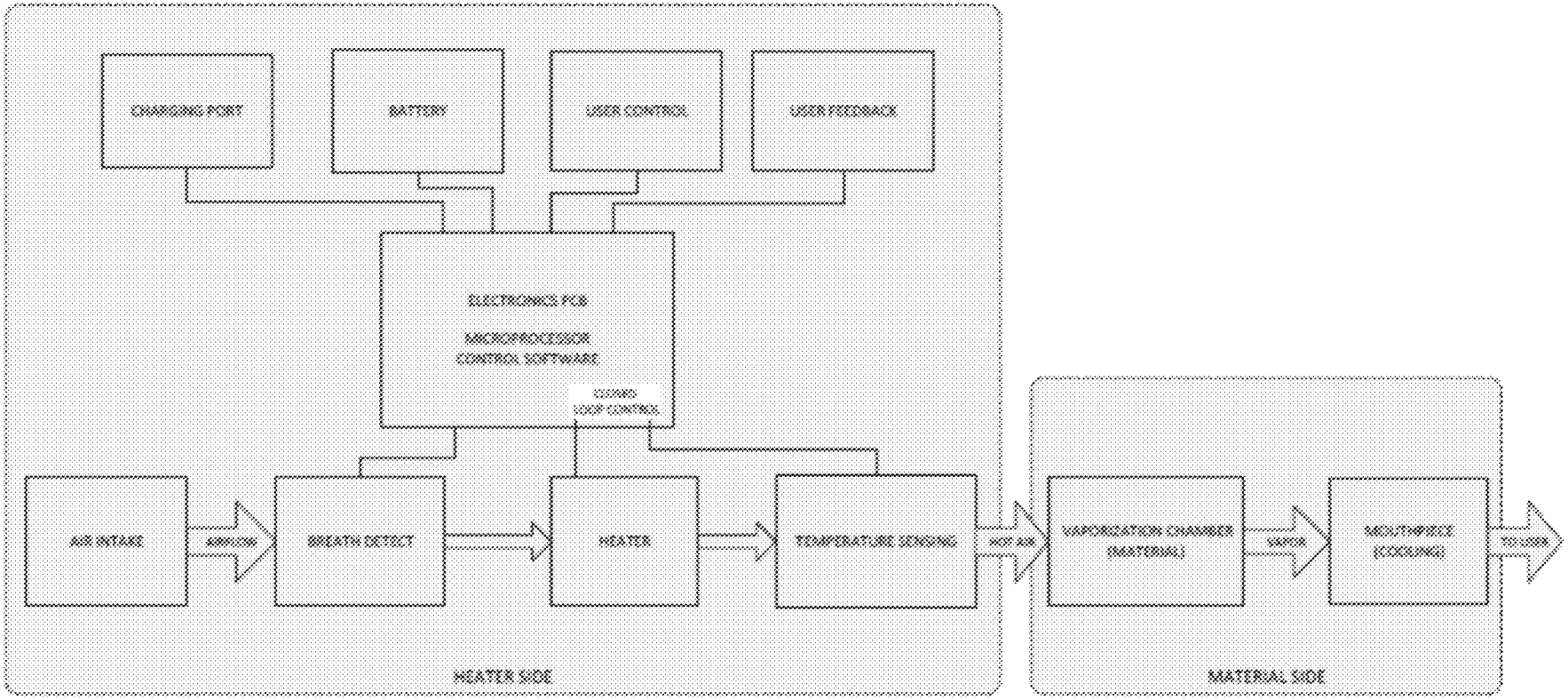
FIG. 17 provides a system block diagram of a vaporization device, according to one example embodiment.
Figure 18:
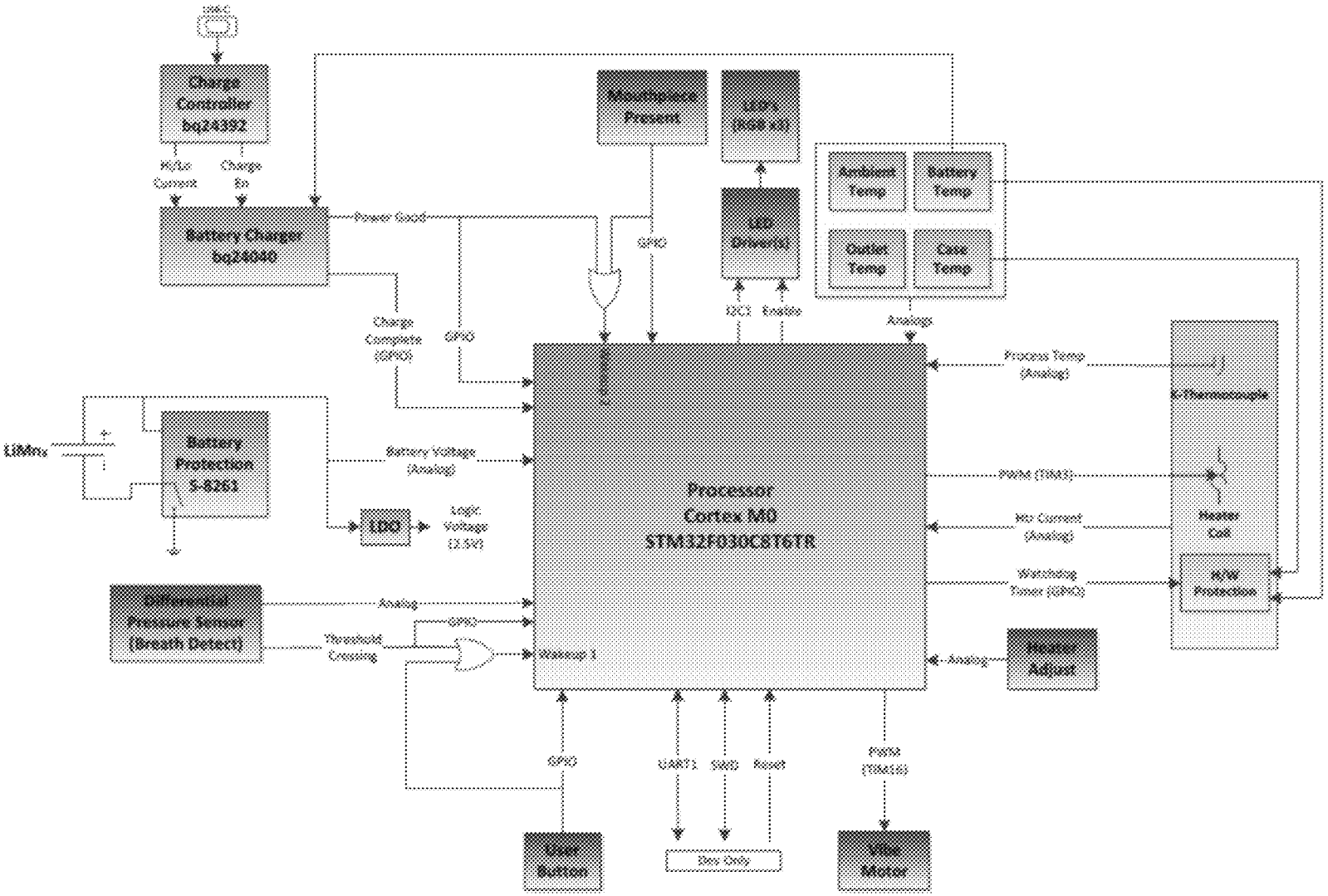
FIG. 18 provides an electronics block diagram of a vaporization device, according to one example embodiment.

FIG. 17 provides a system block diagram of a vaporization device, according to one embodiment, and FIG. 18 provides an electronics block diagram of a vaporization device, according to one example embodiment. Features and associated functionality of the vaporization devices will be readily apparent to those of ordinary skill in the relevant art upon review of the block diagrams and in view of various aspects of the vaporization devices described elsewhere herein. For example, FIG. 17 schematically depicts a control system comprising one or more microprocessors that are communicatively coupled to a power supply (e.g., battery); a charging port, such as may provide power charging functionality for the power supply; one or more user controls (e.g., a trigger), such as may be operated by a user to initiate the vaporization process; one or more user feedback devices (e.g., LEDs, electronic display), such as may be used to communicate information (e.g., power on/off state) to the user; a heater (e.g., wire mesh heater), such as may be used to heat a flow of air moving through the vaporization device during an inhalation event; a breath detection sensor (e.g., pressure sensor), such as may be used to detect an inhalation event and initiate a soft start of the heater; and a temperature sensing device (e.g., thermocouple), such as may be used to detect air temperature and provide a closed loop air temperature control scheme in conjunction with the microprocessor and the heater. The control system may also include one or more memories, such as may store various information and/or processor-executable instructions related to operations of the control system. The control system may also include a wireless communication module for receiving information from and/or transmitting information to external devices or networks.

Figure 19:
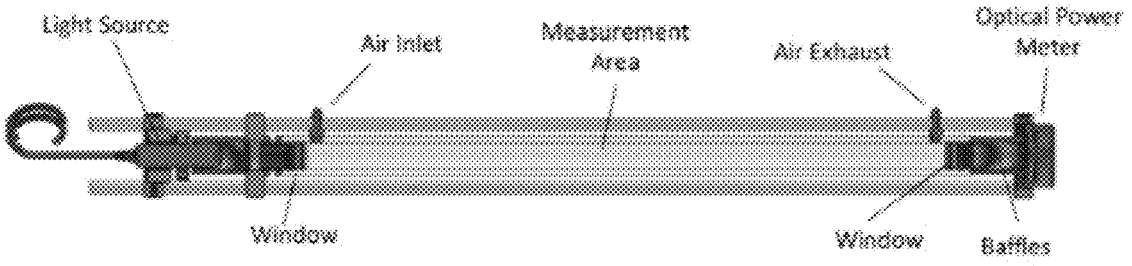
FIG. 19 illustrates a vapor concentration measurement device, according to one example embodiment.
Figure 20:
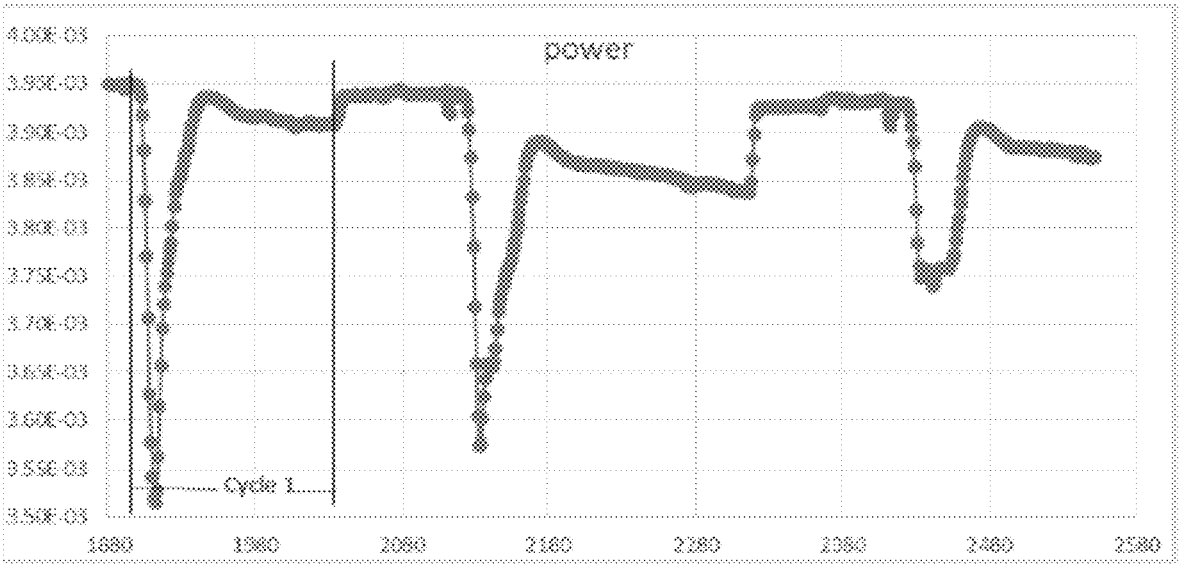
FIG. 20 provides a representative plot of obscuration measurements over three vapor production cycles.

Although not depicted in the example embodiment of the vaporization devices shown in FIGS. 1 through 6, it is appreciated that in some embodiments, a vaporization device (including a benchtop device) may be provided with one or more vapor concentration measurement devices for modifying operational parameters of the vaporization device based at least in part on concentration measurement data obtained therefrom. In some instances, for example, the vaporization device may be configured to measure vapor concentration by obscuration. One example vapor concentration measurement device is depicted in FIG. 19. As shown in FIG. 19, the vapor concentration measurement device may include an elongated measurement chamber through which a flow of vapor may be passed through inlet and exhaust ports with a light source at one end and an optical power meter or photodiode at the other end to measure a change in power readings associated with a decrease in the amount of light reaching the optical power meter or photodiode as a result of light being obscured by vapor in the measurement chamber. FIG. 20 provides a representative plot of obscuration measurements over three vapor production cycles. As an example, the first cycle is characterized by a power reading of about 3.95 mW prior to vapor introduction and a power reading of about 3.51 mW upon vapor introduction, thus resulting in a percentage of light obscuration per foot of about 11.1% ((power before vapor-power during vapor)/(power before vapor)*100). This information can then be used, for example, to determine the concentration of vapor, and ultimately to tailor the delivery of vapor at a desired concentration for precise dosing purposes or to customize user experience by targeting certain constituents. In addition, concentration measurements may be used to determine when the material to be vaporized has been consumed, such as, for example, comparing measured concentration against expected concentration for given operating parameters and/or by monitoring the rate of decline in measured concentration. Additionally, vapor concentration measured in real-time could allow for user feedback from the device to indicate to the user that vapor is being produced. For example haptic feedback may be provided from a vibration device mounted inside the vaporizer, or visual feedback through an indicator (e.g., LED, electronic display), based on such measurements. This may address deficiencies of some known vaporizers in which it is difficult for users to tell if they are receiving vapor.

Figure 21:
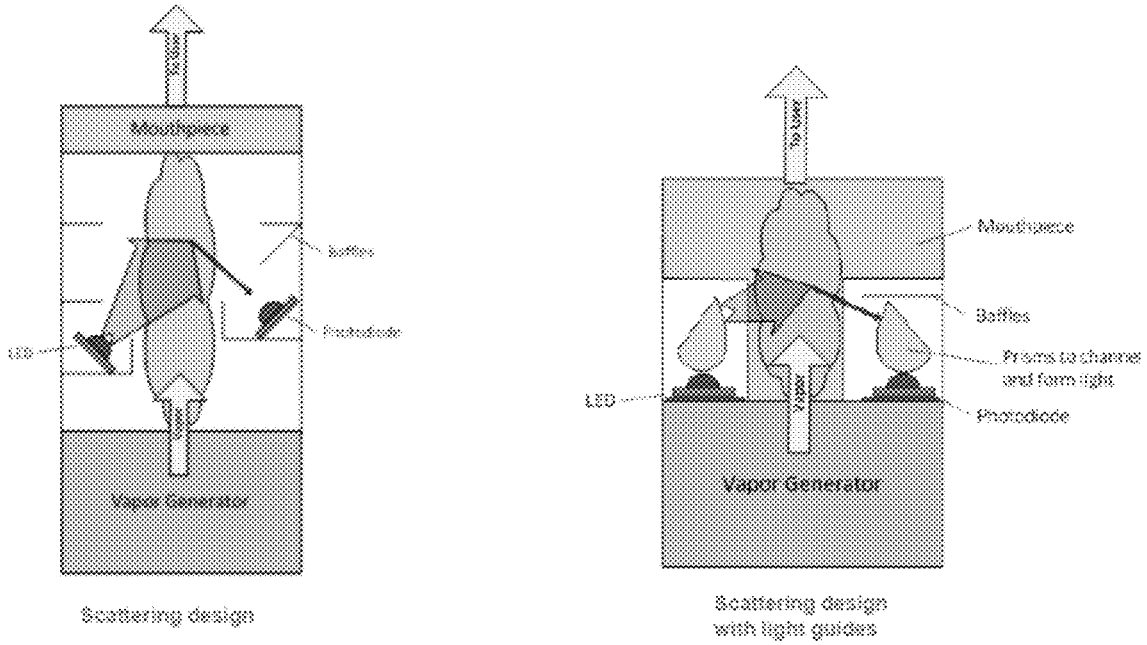
FIG. 21 provides schematic diagrams of two example light scattering/detection arrangements.

In other embodiments, the vaporization device may be configured to measure vapor concentration and/or detect combustion particles via light scattering detection techniques as opposed to measuring obscuration. Measuring light scatter has the aforementioned advantages of detecting vapor concentration by obscuration, but also has the added advantage that it can be used to discriminate effluent from vapor. Detecting, and having the ability to avoid, other gasses or particles in the vapor stream is especially important in applications where end-users cannot tolerate contaminants (e.g., asthmatic users), or more broadly, when vapor purity is desired by the end-user. Furthermore, the scatter detection approach may enable a very compact light source/measurement area/detector to be constructed within a vapor delivery device, such as, for example, a handheld vaporization device. In some instances, light guides may be added to create a form factor in which the light source (e.g., LED(s)) and photodiode are co-planar for ease of packaging. FIG. 21 provides schematic diagrams of two example light scattering arrangements wherein photodiodes are arranged to detect light emanating from a light source (e.g., LED) that is scattered by vapor moving through a vaporization device to be inhaled by a user.

Figure 22:
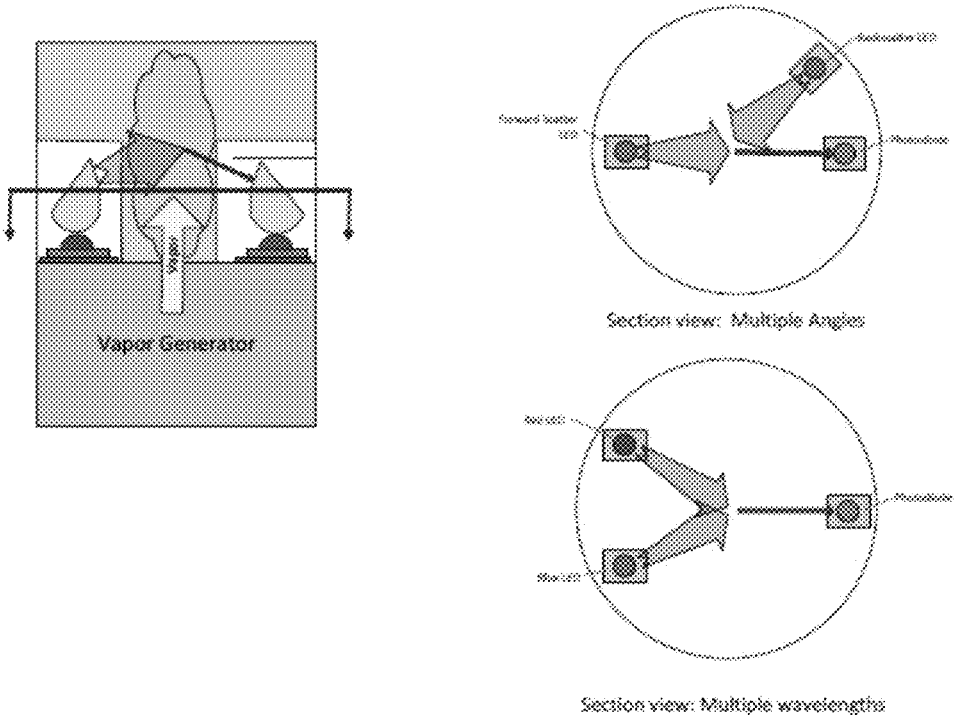
FIG. 22 provides schematic diagrams of two example light scattering arrangements comprising a multi-angle system (upper right image) and a multi-wavelength system (lower right image).

A multi-angle system or a multi-wavelength system may be used to differentiate target vapor from other gasses or particulate streams. Also, absolute magnitude of photodiode signal could be used to differentiate particle size. Any of these methods may in turn be used to differentiate desirable vapor particles from undesirable particles for modifying or otherwise controlling user experience. A vaporizing device may use this differentiation, for example, to maximize vaporization without producing undesirable particles. Differentiating based on wavelength or angle may not be as sensitive to contamination or other outside influences as differentiating based on the absolute magnitude of photodiode signal. Furthermore, wavelength and angle discrimination give particle differentiation independently of vapor concentration, while differentiating based on the absolute magnitude of photodiode signal would not. Since scatter intensity is dependent on incidence angle, wavelength, and particle size, the scatter intensity as measured by the photodiode for each LED, and the ratios of those individual measurements, may be used to determine the type of particles causing the scattering. FIG. 22 provides schematic diagrams of two example light scattering arrangements comprising a multi-angle system (upper right image) and a multi-wavelength system (lower right image).

Aspects and features of the various embodiments described above may also be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A vaporization device for delivering vaporized material for inhalation by a user, the vaporization device comprising:

an air intake through which air enters the vaporization device during an inhalation event;

an outlet through which vapor is withdrawn from the vaporization device during the inhalation event;

a vaporization chamber for accommodating material to be vaporized;

a heater supported upstream of the vaporization chamber with respect to a flow of air through the device during the inhalation event and operable to heat air which passes the heater during the inhalation event as the air moves from the air intake toward the outlet;

a control system, the control system operatively coupled to the heater to provide a control scheme for controlling heat generated by the heater during at least a portion of a duration of the inhalation event; and a vapor concentration detection arrangement operatively coupled to the control system to provide signals indicative of a concentration of vapor in an air-vapor mixture generated in the vaporization chamber.

2. The vaporization device of claim 1, further comprising:

a temperature sensor positioned downstream of the heater with respect to the flow of air through the vaporization device duration the inhalation event and operable to sense a temperature of the air downstream of the heater.

3. The vaporization device of claim 1 wherein the control system is operatively coupled to the temperature sensor and the heater to provide a closed loop control scheme for controlling heat generated by the heater to maintain a temperature of the air delivered to the vaporization chamber at or within a predetermined tolerance of a desired vaporization temperature for at least a majority of the duration of the inhalation event.

4. The vaporization device of claim 1, further comprising:

a nozzle block for supporting the heater upstream of the vaporization chamber, the nozzle block including a nozzle passage shaped to direct the air passing the heater toward a desired location.

5. The vaporization device of claim 1 wherein the vapor concentration detection arrangement comprises one or more light sources and one or more sensors configured to detect vapor concentration via an obscuration technique.

6. The vaporization device of claim 1 wherein the vapor concentration detection arrangement comprises one or more light sources and one or more sensors configured to detect vapor concentration via a light scattering technique.

7. The vaporization device of claim 1 wherein the heater is a mesh heater operable to heat air which passes through the mesh heater during the inhalation event as the air moves from the air intake toward the outlet.

8. The vaporization device of claim 7 wherein the mesh heater comprises a mesh of a first material and a frame of a second material, the mesh being fixed to the frame and supported by the frame within the vaporization device.

9. The vaporization device of claim 8 wherein the first material of the mesh is a stainless steel material and the second material of the frame is a ceramic material.

10. The vaporization device of claim 8 wherein the frame is a portion of a frame assembly that further comprises opposing bus bars integrally formed therewith, and wherein opposing ends of the mesh and heater leads are bonded to the opposing bus bars for supplying current through the mesh in accordance with the control scheme.

11. The vaporization device of claim 1 wherein the vaporization chamber is defined at least in part by a heat exchanger, the heat exchanger including a plurality of vapor flow passages extending between the vaporization chamber and the outlet.

12. The vaporization device of claim 11 wherein the plurality of vapor flow passages in the heat exchanger comprise opposing passages offset from a central plane of the vaporization device, a central portion of the heat exchanger providing an obstruction around which the vapor must flow to reach the outlet, and whereby heat is transferred from the vapor to the heat exchanger as the vapor moves toward the outlet.

13. The vaporization device of claim 12 wherein the heat exchanger is configured such that a portion of the heat transferred to the heat exchanger from the vapor is conducted upstream to a location adjacent the vaporization chamber to assist in heating the material to be vaporized via conduction.

14. The vaporization device of claim 1 wherein the control system includes one or more microprocessors and is configured to initiate a soft start in response to an initiation signal and to transition to a closed loop control scheme upon detection of a thermal response that exceeds a threshold level or threshold rate of temperature change arising from inhalation by a user.

15. The vaporization device of claim 14, further comprising a trigger device accessible to the user to enable the user to generate the initiation signal.

16. The vaporization device of claim 14, further comprising a pressure sensor communicatively coupled to the control system to generate the initiation signal upon sensing a change in pressure associated with inhalation by the user.

17. The vaporization device of claim 14 wherein the control system is further configured to disable the heater upon detection of a divergence of a measured air temperature associated with a delivered heater power from an expected air temperature, the divergence arising from a lack of air flow through the vaporization device resulting from cessation of the inhalation event.

18. The vaporization device of claim 1 wherein the vaporization device further comprises a vaporization head removably coupled to a base assembly, the base assembly including the heater, the control system and a power source accommodated within a housing.

19. The vaporization device of claim 18 wherein the vaporization head includes a heat exchanger received within a mouthpiece, the vaporization chamber defined at least in part by the heat exchanger.

20. The vaporization device of claim 18 wherein the vaporization head is removably coupled to the base assembly via a magnetic coupling.

21. A vapor delivery device, comprising:

a vaporization chamber to receive matter to be vaporized;

a heater located upstream of the vaporization chamber;

a vapor concentration detection arrangement configured to provide signals indicative of a concentration of vapor in an air-vapor mixture generated in the vaporization chamber from which to modify operation of the heater;

one or more processors; and at least one memory, the memory including instructions that, upon execution by at least one of the one or more processors, cause the heater to maintain a temperature of air delivered to the vaporization chamber at or within a predetermined tolerance of a desired vaporization temperature for at least a majority of a duration of an inhalation event.

* * * * *